US010280658B2

(12) United States Patent
Halliwell et al.

(10) Patent No.: US 10,280,658 B2
(45) Date of Patent: May 7, 2019

(54) RETRACTABLE HANDLE FOR A DOOR OR THE LIKE

(76) Inventors: Martin Charles Halliwell, Whitley (GB); Heather McEntee, Whitley (GB)

( * ) Notice: Subject to any disclaimer, the term of this patent is extended or adjusted under 35 U.S.C. 154(b) by 138 days.

(21) Appl. No.: 13/522,321

(22) PCT Filed: Jan. 13, 2011

(86) PCT No.: PCT/EP2011/050422

§ 371 (c)(1),
(2), (4) Date: Oct. 9, 2012

(87) PCT Pub. No.: WO2011/086144

PCT Pub. Date: Jul. 21, 2011

(65) Prior Publication Data

US 2013/0241215 A1 Sep. 19, 2013

(30) Foreign Application Priority Data

Jan. 15, 2010 (GB) ..... 1000664.1

(51) Int. Cl.
*E05B 81/08* (2014.01)
*E05B 81/76* (2014.01)
(Continued)

(52) U.S. Cl.
CPC ..... *E05B 85/107* (2013.01); *E05B 81/08* (2013.01); *E05B 81/76* (2013.01); *E05B 85/103* (2013.01); *E05B 85/16* (2013.01); *Y10T 292/57* (2015.04)

(58) Field of Classification Search
CPC . E05B 5/00; E05B 5/003; E05B 5/006; E05B 85/103; E05B 85/107; E05B 81/08;
(Continued)

(56) References Cited

U.S. PATENT DOCUMENTS 2,117,160 A * 5/1938 Gale ..... E05B 85/18 292/139
3,020,075 A * 2/1962 Johnstone ..... E05B 85/14 16/412
(Continued)

FOREIGN PATENT DOCUMENTS

DE 4002963 7/1991
DE 19731325 A1 1/1999
(Continued)

OTHER PUBLICATIONS

International Search Report for PCT/EP2011/050422 dated May 20, 2011, 3 pages.
(Continued)

*Primary Examiner* — Kristina R Fulton
*Assistant Examiner* — Faria F Ahmad
(74) *Attorney, Agent, or Firm* — Reising Ethington P.C.

(57) ABSTRACT

A retractable handle arrangement comprises a handle movable between stowed, deployed and operative states. That movement is controlled by a mechanism having first and second links each connected to a supporting structure and to the handle. At least one of those links is connected to the supporting structure by a joint defining a pivot axis that is movable is response to movement of the handle between the deployed state and the operative state. That movement of the pivot axis is used to unlatch a door or other closure associated with the handle, for example via a crank acting on a Bowden cable.

20 Claims, 6 Drawing Sheets

(51) Int. Cl.
*E05B 85/10* (2014.01)
*E05B 3/00* (2006.01)
*E05B 85/16* (2014.01)

(58) Field of Classification Search
CPC ..... E05B 81/76; E05B 85/14; E05B 85/16; E05B 85/18; E05B 85/10; Y10T 292/57
USPC ..... 292/336.3, DIG. 31; 49/460, 394
See application file for complete search history.

(56) References Cited

U.S. PATENT DOCUMENTS 3,993,338 A * 11/1976 Cherbourg ..... B60J 5/06 292/336.3
3,993,339 A * 11/1976 Cherbourg ..... E05B 5/00 292/336.3
4,475,754 A * 10/1984 Arlauskas ..... E05B 85/16 292/336.3
4,482,179 A * 11/1984 Johnson ..... E05B 1/0038 292/336.3
5,123,687 A * 6/1992 Pfeiffer ..... E05B 1/0092 292/336.3
5,530,990 A * 7/1996 Chen ..... A45C 13/22 16/113.1
5,632,516 A * 5/1997 Schwab ..... E05B 85/18 292/336.3
5,829,802 A * 11/1998 Anderson ..... E05B 7/00 292/336.3
5,860,684 A * 1/1999 Mizuki ..... E05B 83/36 292/336.3
5,975,597 A * 11/1999 Makiuchi ..... E05B 85/16 292/336.3
6,497,437 B1 12/2002 Münch et al.
6,523,870 B2 * 2/2003 Schlack ..... E05B 7/00 292/336.3
6,575,508 B2 * 6/2003 Stuart ..... E05B 77/06 292/336.3
6,598,912 B2 * 7/2003 Hillgaertner ..... E05B 13/005 292/225
6,609,737 B2 * 8/2003 Fisher ..... E05B 81/06 292/201
6,698,262 B2 * 3/2004 Wittwer ..... E05B 85/107 292/336.3
6,712,409 B2 * 3/2004 Monig ..... E05B 77/06 292/336.3
6,840,552 B2 * 1/2005 Ramsauer ..... E05B 1/0092 292/336.3
7,036,855 B2 * 5/2006 Lin ..... E05B 85/16 292/216
7,108,301 B2 * 9/2006 Louvel ..... E05B 81/78 292/201
7,204,530 B2 * 4/2007 Lee ..... E05B 85/12 292/336.3
7,210,716 B2 * 5/2007 Mueller ..... E05B 77/06 292/336.3
7,216,402 B2 * 5/2007 Nishiyama ..... E05B 85/12 16/412
7,347,461 B2 * 3/2008 Sprague ..... E05B 1/00 200/61.62
7,594,684 B2 * 9/2009 Hidaka ..... B60N 3/023 16/110.1
8,100,363 B2 * 1/2012 Ponsart ..... B64C 1/1446 244/129.4
8,136,853 B2 * 3/2012 Ito ..... E05B 81/78 292/336.3
8,146,393 B2 * 4/2012 Katagiri ..... E05B 17/18 292/336.3
8,282,142 B2 * 10/2012 Fannon ..... E05B 79/12 292/336.3
8,348,357 B2 * 1/2013 Briggs ..... E05B 65/462 312/218
8,359,889 B2 * 1/2013 Katagiri ..... E05B 17/18 292/336.3
8,443,553 B1 * 5/2013 Polewarczyk ..... E05B 81/77 16/412
8,690,204 B2 * 4/2014 Lang ..... E05B 81/77 292/279
8,701,353 B2 * 4/2014 Patel ..... E05B 81/34 292/144
8,919,047 B2 * 12/2014 Johnsrud ..... E05B 85/103 292/336.3
8,943,752 B2 * 2/2015 Thomas ..... E05B 85/10 49/394
9,062,478 B2 * 6/2015 Bingle ..... E05B 81/28
9,080,352 B2 * 7/2015 Aerts ..... E05B 85/103
9,103,143 B2 * 8/2015 Wheeler ..... E05B 85/00
9,151,089 B2 * 10/2015 Aerts ..... E05B 85/103
9,249,608 B2 * 2/2016 Lang ..... E05B 85/103
2002/0070567 A1 * 6/2002 Ciborowski ..... E05B 85/16 292/336.3
2003/0019261 A1 * 1/2003 Wittwer ..... E05B 85/107 70/257
2003/0155780 A1 * 8/2003 Bucker ..... E05B 77/02 292/336.3
2004/0061342 A1 * 4/2004 Ramsauer ..... E05B 1/0092 292/336.3
2004/0222649 A1 * 11/2004 Ito ..... E05B 1/0053 292/336.3
2007/0069531 A1 * 3/2007 Herbert ..... E05B 85/107 292/336.3
2007/0120382 A1 * 5/2007 Chevalier ..... E05B 77/06 292/336.3
2008/0163555 A1 * 7/2008 Thomas ..... E05B 85/10 49/460
2009/0079233 A1 * 3/2009 Hidaka ..... B60N 3/023 296/210
2010/0127516 A1 * 5/2010 Fannon ..... E05B 79/12 292/336.3
2012/0061162 A1 * 3/2012 Savant ..... A47B 47/0008 180/274
2013/0049403 A1 * 2/2013 Fannon ..... E05B 83/24 296/193.11
2013/0127185 A1 * 5/2013 Lang ..... E05B 81/77 292/336.3
2013/0170241 A1 * 7/2013 Lesueur et al. ..... 362/501
2013/0229022 A1 * 9/2013 Lesueur ..... E05B 85/14 292/336.3
2013/0241215 A1 * 9/2013 Halliwell ..... E05B 85/107 292/336.3
2014/0083016 A1 * 3/2014 Schryer ..... B60N 3/026 49/460
2016/0298366 A1 * 10/2016 Och ..... E05B 85/103
2017/0066312 A1 * 3/2017 Coutier ..... B60J 9/00
2017/0260780 A1 * 9/2017 Christensen ..... E05B 81/77
2018/0058113 A1 * 3/2018 Han ..... E05B 79/20

FOREIGN PATENT DOCUMENTS

DE 102008019335 10/2008
DE 102008030580 1/2009
EP 1403453 3/2004
EP 2524096 A1 11/2012
GB 2345437 A 7/2000
JP 2005330721 A 12/2005

OTHER PUBLICATIONS

Great Britain Search Report for corresponding application No. GB1000664.1, dated Apr. 20, 2011, 2 pages.
IPER/Written Opinion for application No. PCT/EP2011/050422, dated Jan. 13, 2011, 6 pages.

* cited by examiner

RETRACTABLE HANDLE FOR A DOOR OR THE LIKE

TECHNICAL FIELD

This invention relates to a retractable handle for a door or other closure.

The invention will be described in the context of a car door but it can be used with other closures on a vehicle, such as a tailgate, or with other types of vehicle, such as aircraft. Indeed, in a broad sense, the retractable handle arrangement of the invention can be used in non-vehicular applications.

BACKGROUND

The demands of aesthetics, aerodynamics and wind-noise control often make it desirable for a door handle to lie flush with the surrounding door skin of a vehicle. Flap-type door handles may be used for this reason. Such handles comprise a typically top-pivoted flap that is pulled against spring bias and hence pivoted outwardly with respect to the surrounding door skin to unlatch the door. A finger recess is usually provided in the door skin adjacent to—most commonly underneath—the flap of the handle. This recess gives finger access to the rear of the handle so that the handle may be pulled to unlatch and open the door.

A flap-type handle tends to be awkward to use and cannot be grasped as comfortably or satisfyingly as other handle types. Perhaps the most convenient handle type has a protruding bar-like grab or handgrip that may be gripped in the user's hand, an example being a strap-type handle in which the handgrip is part of a loop.

Strap-type handles have particular benefits over flap-type handles in terms of ergonomics and load transferral: for example, when using a flap-type handle, it is not possible for the user to choose whether to use an overhand or underhand grip style. Also, a flap-type handle constrains where the handle may be positioned on the vehicle with respect to the user's stance. Unfortunately, however, the protruding handgrip of a strap-type handle does not have the benefits of flush mounting.

A flap-type handle with its associated finger recess is also an aesthetic constraint. There have therefore been several proposals in the prior art to provide a finger recess with a hinged cover plate that lies flush with the door skin and with the adjacent flap-type handle but that pivots inwardly to admit the user's fingers to operate the handle. However, this cover plate does not solve the inherent problems of a flap-type handle: if anything, it makes the handle more difficult to use. Also, arguably, a cover plate may look no better than leaving the finger recess uncovered.

To solve some of these problems and to offer a 'surprise and delight' feature, some flush-mounted door handles are retractably mounted to a vehicle. This means that the handle can move between two states: a stowed or retracted state in which the handle is flush-mounted and a deployed or extended state in which the handle stands proud of the surrounding bodywork to be easier to grasp.

Once in the deployed state, the handle can then be pulled to open the door. This involves moving the handle to a third, operative state to unlatch the door, typically by pivoting the deployed handle against spring bias. In moving from the deployed state to the operative state, the handle may unlatch the door mechanically—for example by pulling a Bowden cable acting on the door latch—or electrically—for example by switching a solenoid acting on the door latch.

In a recent example used in Aston Martin cars, a flush-mounted door handle comprises a lever bar pivotally attached near one end to a door. In the stowed state, the lever bar lies flush with the door skin. In the deployed state, a major portion of the lever bar pivots outwardly from the door skin so that a user may grasp and pull it out further into the operative state to unlatch and open the door. A user moves the handle from the stowed state to the deployed state by pressing in the front end of the lever bar against spring bias so that the lever bar pivots outwardly at its rear end. Whilst intriguing, this arrangement is somewhat awkward and it is not intuitive to use.

U.S. Pat. No. 6,598,913 discloses a door handle having a face plate that, when stowed, lies flush with the door skin. When a user presses the face plate, the face plate pops out under spring bias to a deployed state where it may be gripped by the user and pulled outwardly into an operative state to unlatch and open the door. However, this involves two manual operations and requires dexterity. Also, the face plate operates in the manner of a flap-type handle and so suffers from many of its disadvantages.

U.S. Pat. No. 5,123,687 discloses a retractable strap-type car door handle having a mechanism comprising two pivot levers on fixed pivot axes, one at each end of the handle. The levers are joined by a link rod that causes both levers to move together between the stowed and deployed states. Once deployed, one end of the handle is displaced relative to the associated pivot lever to move the handle into the operative position in which the handle unlatches the door. The mechanism is complex and bulky, noting that much of the mechanism lies inboard of the handle. The mechanism therefore requires a space of considerable depth between the window glass path and the door skin, where space is usually at a premium.

It is against this background that the present invention has been devised.

SUMMARY

According to one aspect of the present invention there is provided a retractable handle arrangement, comprising a handle movable between stowed, deployed and operative states, that movement being controlled by a mechanism having first and second links each connected to a supporting structure and to the handle; wherein the second link is connected to the supporting structure by a joint defining a pivot axis that is movable is response to movement of the handle between the deployed state and the operative state, that movement of the pivot axis being used to unlatch a door or other closure associated with the handle.

In the preferred embodiment disclosed, movement of the pivot axis is controlled by a guide defining a guide path, the second link having a follower that follows the guide path as the handle moves. Advantageously, movement of the pivot axis is restrained as the handle moves between the stowed and deployed states, in which case the guide path suitably comprises a first portion that restrains movement of the pivot axis as the handle moves between the stowed and deployed states, and a second portion adjoining and communicating with the first portion that enables movement of the pivot axis as the handle moves between the deployed and operative states. Thus, when the handle is in the deployed state, the follower may be located where the first and second portions of the path adjoin.

The movable pivot axis may be movable around a further pivot axis, such as may be defined by a pivot on a crank arm that is pivotable about the further pivot axis.

Elegantly, the handle may be pivotally attached to the first link to pivot about that link when moving from the deployed state to the operative state. To conceal the mechanism from a user, the first link preferably moves within a hollow part of the handle as the handle moves between the stowed and deployed states.

An actuator may act on at least one of the links to drive movement of the link between the stowed and deployed states. For example, the actuator suitably defines a drive path and the link has a follower that follows the drive path, the drive path acting as a cam on the follower to move the link in response to movement of the actuator.

Advantageously, the actuator and the link are cooperable to lock the link in at least one of the stowed and deployed states. For this purpose, at least one detent position may be associated with the drive path, at which position the follower lies to lock the link.

For compactness, the second link may comprise spaced elements with the first link being disposed between those elements. To minimise the depth of the mechanism, it is preferred that substantially all of the mechanism—other than the parts of the links that connect to the handle—is disposed beside the handle either to an end or side of the handle.

The links of the mechanism suitably define a four-bar linkage as the handle moves between the stowed and deployed states, but when the handle moves between the deployed and operative states, at least one of the links is decoupled from the four-bar linkage.

The inventive concept embraces a vehicle fitted with the handle arrangement of the invention. The inventive concept also extends to a door or other closure, or a structure adapted to receive a door or other closure, fitted with the handle arrangement of the invention.

The invention combines the benefits of flush exterior door handles with a strap-type configuration when in use. It allows a retractable strap-type handle to satisfy the conflicting requirements of sufficient ergonomic access for the user's hand and compliance with legislation governing exterior projections on vehicles.

According to another aspect of the invention for which protection is sought, there is provided a handle arrangement for a vehicle door, the arrangement comprising a strap-type handle and linkage means arranged to couple the handle to the door for movement between a first position in which the handle lies substantially flush with an outer surface of the door and a second position in which the handle protrudes from the outer surface of the door.

In one embodiment, the linkage means is arranged to permit the handle to translate from the first position to the second position. In an embodiment, the linkage means is arranged to permit the handle in the second position to rotate about a pivot point thereby to disengage a door latch or the like. In one embodiment, the linkage means is coupled to one end only of the handle.

Within the scope of this application the various aspects, embodiments, examples, features and alternatives set out in the preceding paragraphs, in the claims and/or in the following description and drawings may be taken independently or in any combination thereof.

BRIEF DESCRIPTION OF THE DRAWINGS

The present invention will now be described, by way of example only, with reference to the accompanying drawings in which.

DETAILED DESCRIPTION OF THE ILLUSTRATED EMBODIMENT(S)

Figure 1A:
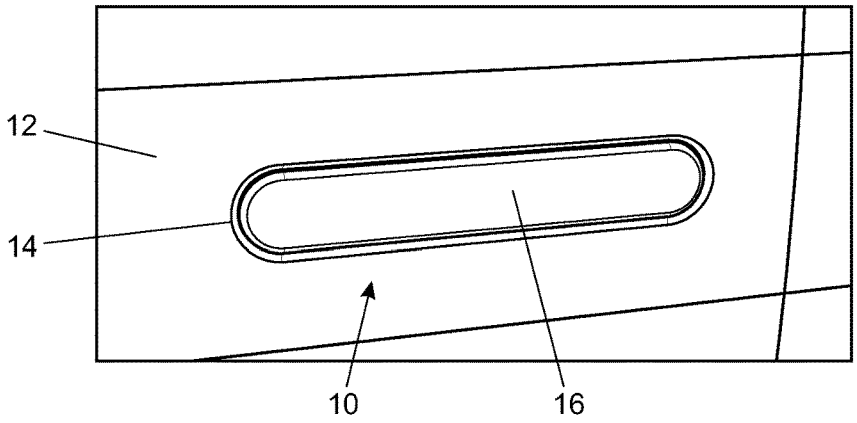
FIGS. 1(*a*), 1(*b*) and 1(*c*) are front perspective views from the exterior of a vehicle door fitted with a door handle arrangement in accordance with the invention, the door handle being shown respectively in stowed, deployed and operative states.
Figure 1B:
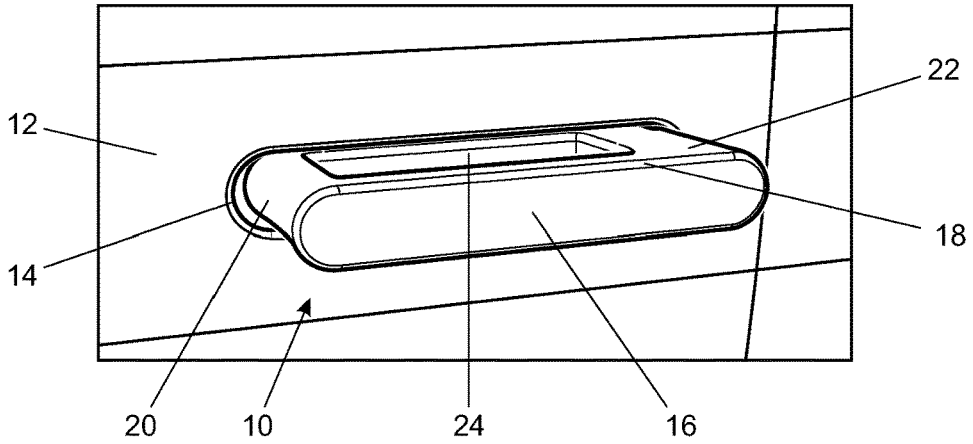
Figure 1C:
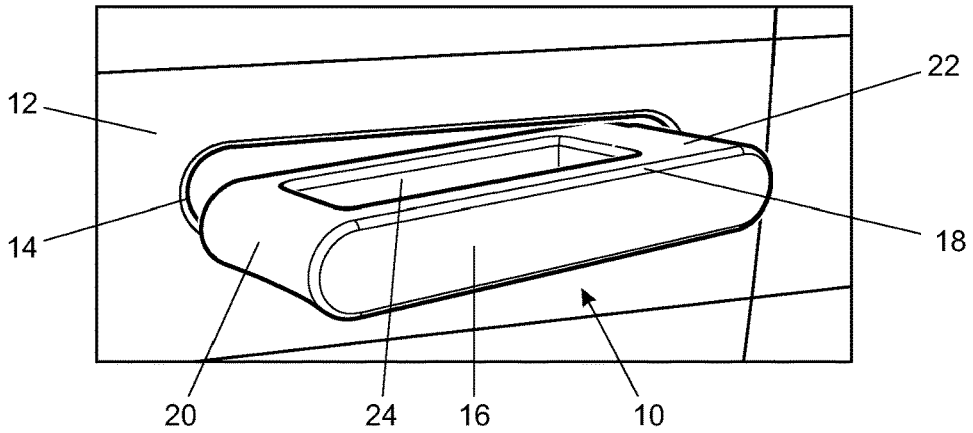

Referring firstly to the exterior views in FIGS. 1(*a*), 1(*b*) and 1(*c*) of the drawings, in a door handle arrangement of the invention, a flush-mounted door handle 10 is retractable with respect to a door of a vehicle. A painted door skin 12 is shown here to represent the door.

The door skin 12 is penetrated by a horizontally-extending slot 14 that receives the handle 10 as a close fit. The outer surface 16 of the handle 10 is shaped to match the slot 14 and lies flush with the surrounding door skin 12 when the handle 10 is stowed as shown in FIG. 1(*a*). The shape of the slot 14 and of the outer surface 16 of the handle 10 is chosen for aesthetic reasons and is largely immaterial in terms of function.

Whilst shown in a contrasting tone for clarity in the drawings, at least the outer surface 16 of the handle 10, and possibly the entire handle 10, is preferably painted in the same colour as the vehicle body. Other finishes may, of course, be chosen instead, again for aesthetic reasons.

In FIG. 1(*b*), the handle 10 has been deployed, protruding from the slot 14 in a pop-out manner. It will now be evident that the handle 10 is a strap-type handle defining a loop. The loop comprises a handgrip 18 that defines the outer surface 16, with end-pieces 20, 22 at opposed ends spacing the handgrip 18 from a parallel inner member 24 that is shaped like the handgrip 18 to fill the slot 14 when the handle 10 is deployed. The end-pieces 20, 22 are generally parallel to each other but they are not orthogonal to the handgrip 18 or to the inner member 24; instead they are inclined such that the loop approximates to a parallelogram shape in plan view. Again, this shape may be determined largely by aesthetic considerations.

Both end-pieces 20, 22 are hollow and one end-piece 22 is substantially wider than the other end-piece 20 in the longitudinal direction of the handle 10. This is to accommodate and conceal a primary link 26 of the door handle mechanism 28 that is apparent in FIGS. 2(*a*) to 2(*c*) and will be described fully later.

The handle 10 may be driven from its stowed state to its deployed state in response to various events. For example, this movement may be in response to an unlocking signal from a key authorised to unlock the vehicle or from a presence sensor that detects the presence of an authorised key in the immediate vicinity of the vehicle. Conversely the handle may be driven from its deployed state to its stowed state in response to a locking signal from a key authorised to lock the vehicle or from a presence sensor that determines that the authorised key has left the immediate vicinity of the vehicle. The handle may also toggle between the stowed and deployed states in response to a further action from the user, for example pressing a switch (not shown) on the vehicle door.

Figure 2A:
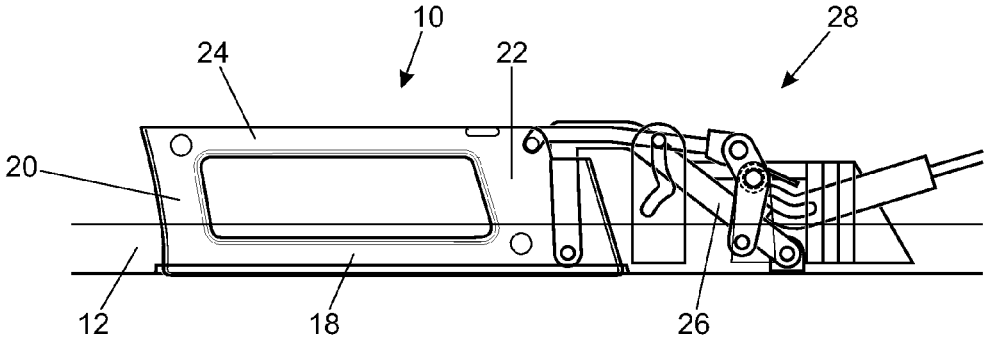
FIGS. 2(*a*), 2(*b*) and 2(*c*) are a sequence of top sectional views of the door and door handle arrangement of FIGS. 1(*a*), 1(*b*) and 1(*c*), with the door handle also being shown respectively in the stowed, deployed and operative states.
Figure 2B:
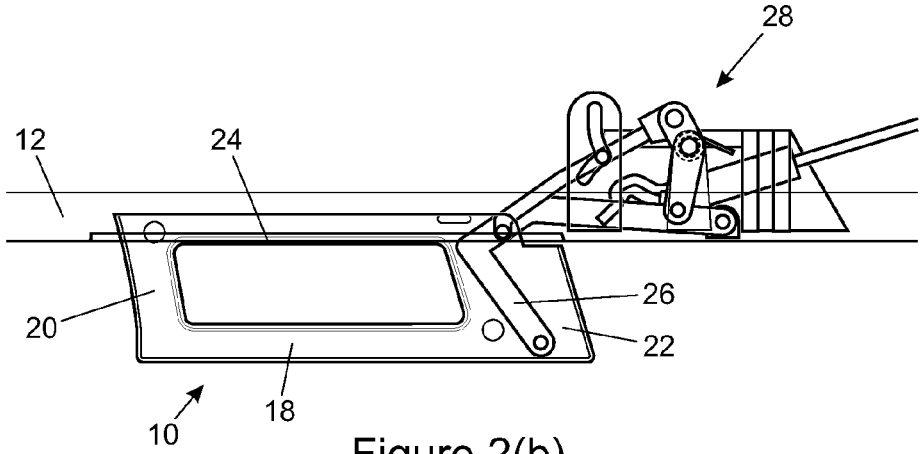
Figure 2C:
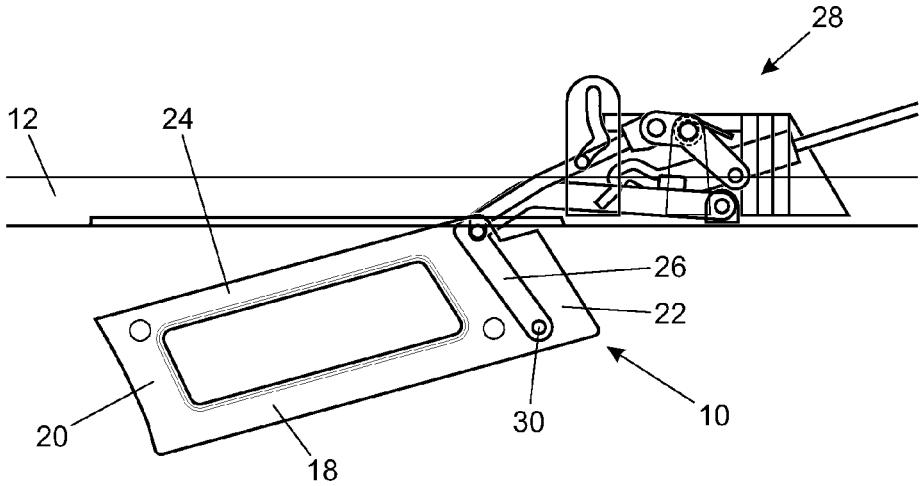

Comparison of the corresponding plan views of FIGS. 2(*a*) and 2(*b*) will show that the result of movement of the handle 10 between the stowed and deployed states is a translation, with no significant angular movement of the handle 10.

Once in the deployed state, the handle 10 can then be pulled to open the door. This involves the user pivoting the handle 10 outwardly against spring bias to the operative state shown in FIG. 1(*c*) to unlatch the door. Here, the handle 10 has been pivoted about a substantially vertical pivot axis 30 situated to one end of the handle 10, as best shown in the corresponding plan view of FIG. 2(*c*). A hinge at the free end of the primary link 26 defines that axis 30, as will be explained.

When grasping the handgrip 18 to pull the handle, the user's fingers and possibly also the thumb can extend into the loop between the handgrip 18 and the inner member 24 The loop is open to the top and bottom and so allows a user to grasp the handgrip 18 using an overhand or underhand grip, whichever may be easier and more comfortable for the user.

In being moved from the deployed state to the operative state, the handle 10 may unlatch the door mechanically or electrically. In the door handle mechanism 28 that will now be described in detail, unlatching is performed mechanically when pulling the handle 10 causes the mechanism to pull a Bowden cable to act on the door latch in well-known manner. However, unlatching could be performed electrically instead.

Figure 3A:
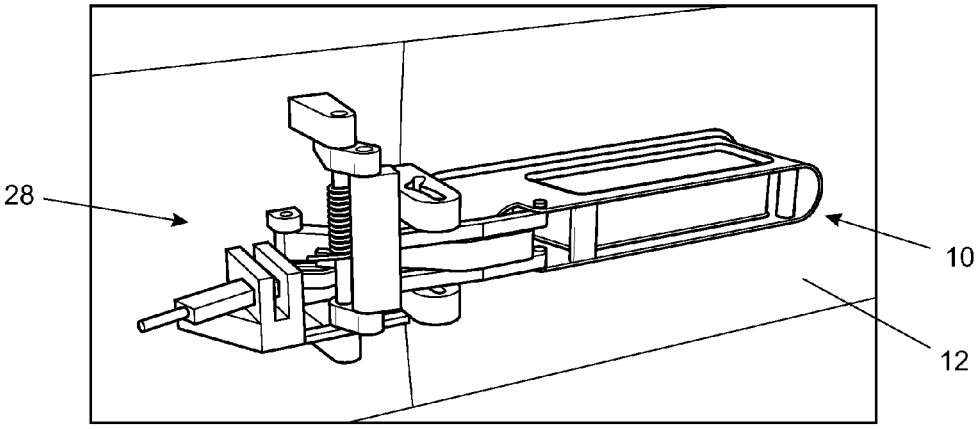
FIGS. 3(*a*), 3(*b*) and 3(*c*) are rear perspective views from the interior of a vehicle door fitted with the door handle arrangement of FIGS. 1(*a*), 1(*b*) and 1(*c*), with the door handle again being shown respectively in the stowed, deployed and operative states.
Figure 3B:
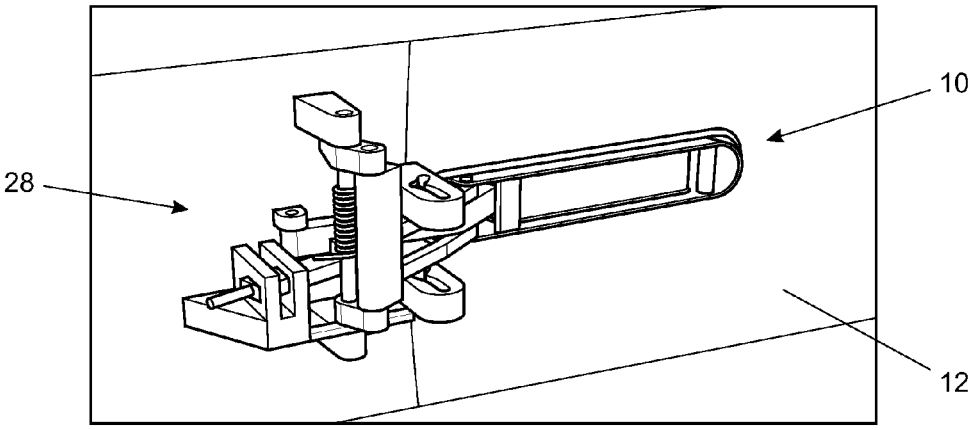
Figure 3C:
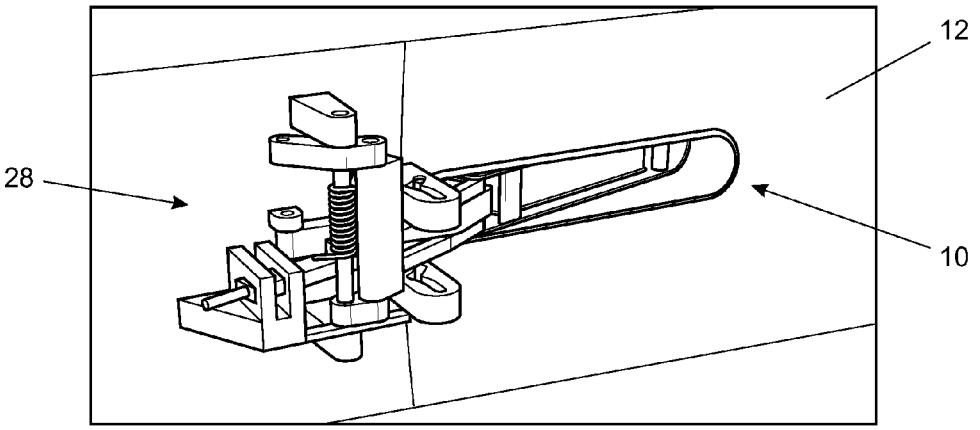
Figure 4A:
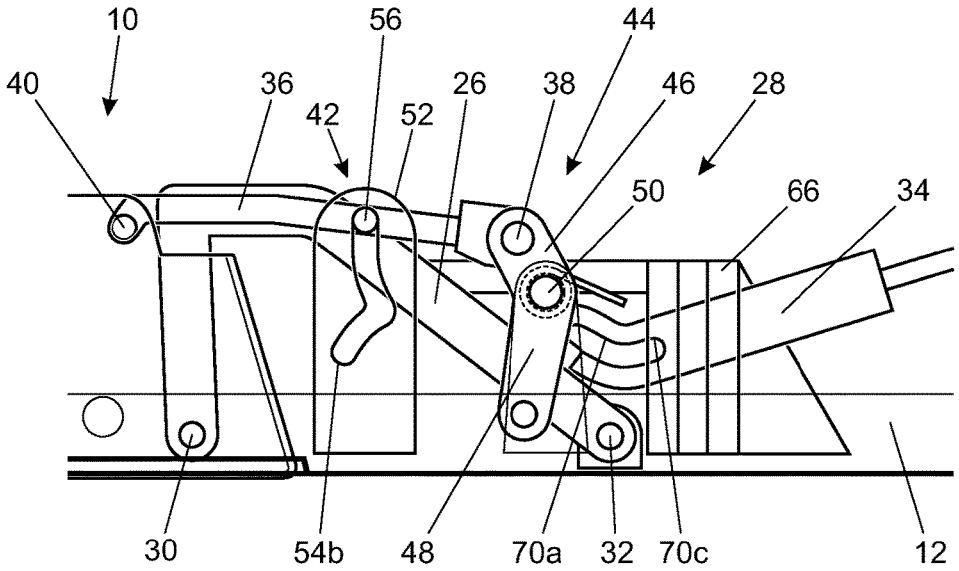
FIGS. 4(*a*) and 4(*b*) are enlarged top sectional and rear perspective views, respectively, showing a mechanism of the door handle arrangement when the handle is stowed.
Figure 4B:
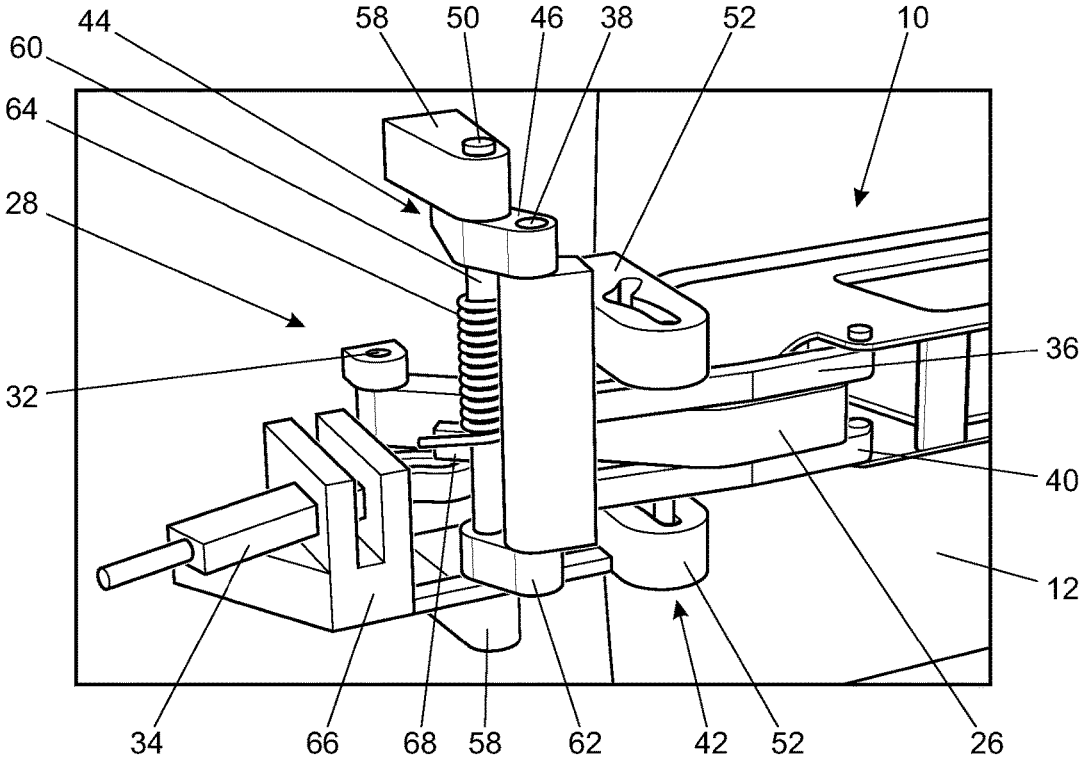
Figure 5A:
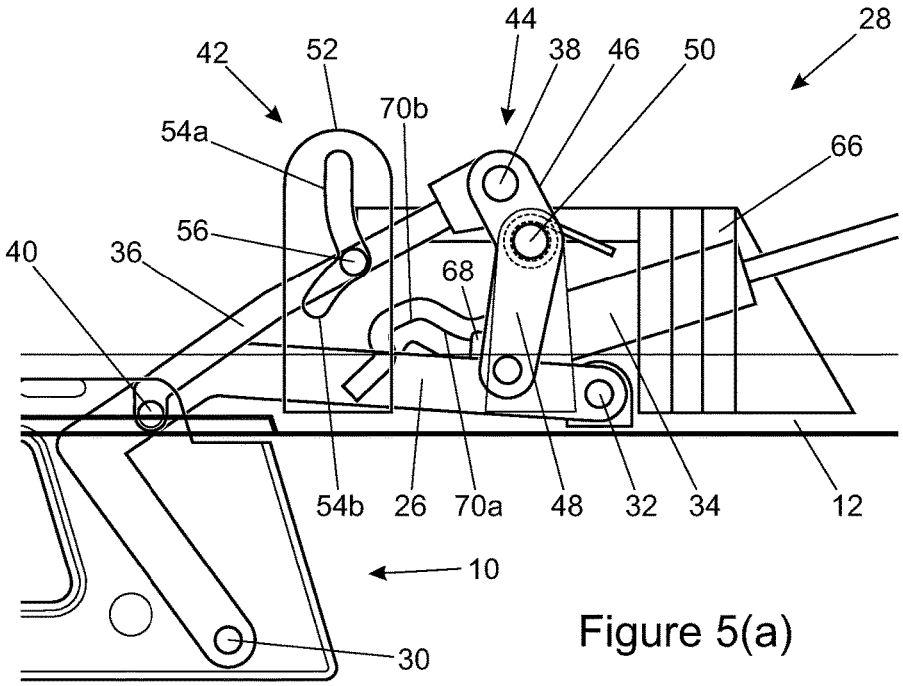
FIGS. 5(*a*) and 5(*b*) are enlarged top sectional and rear perspective views, respectively, showing the door handle mechanism when the handle is deployed.
Figure 5B:
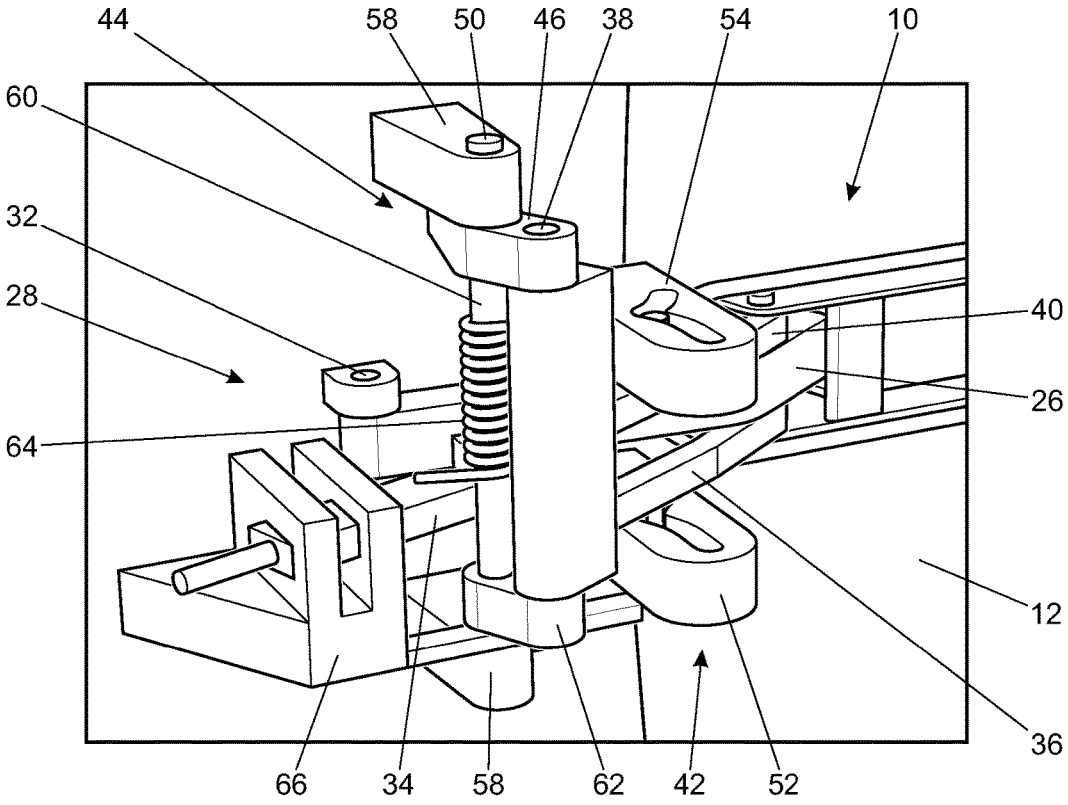
Figure 6A:
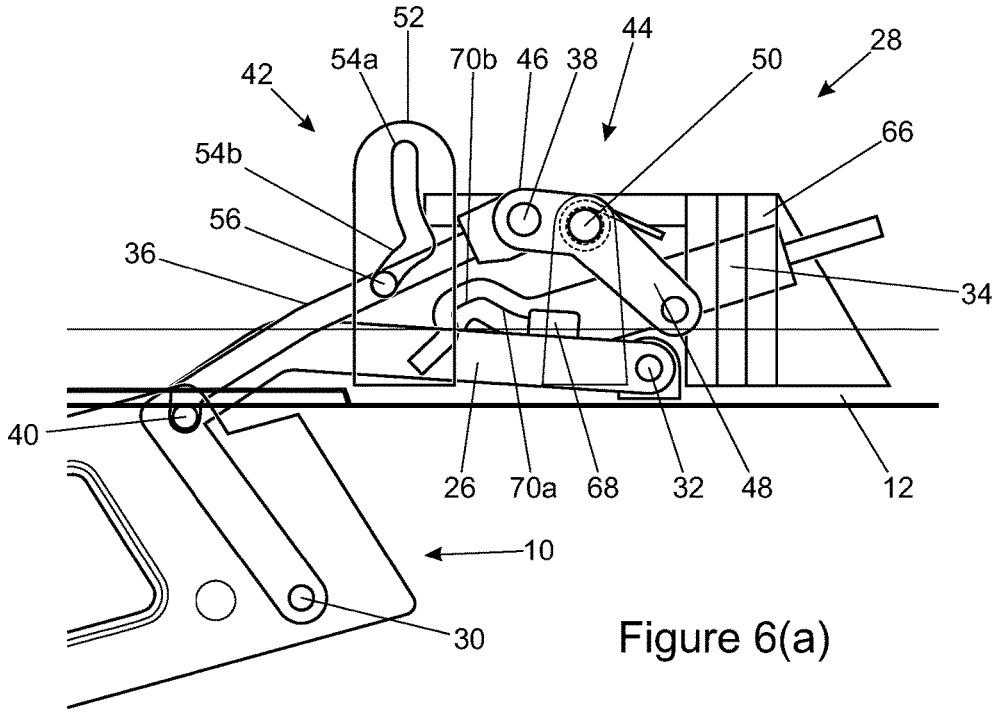
FIGS. 6(*a*) and 6(*b*) are enlarged top sectional and rear perspective views, respectively, showing the door handle mechanism when the handle is in the operative state.
Figure 6B:
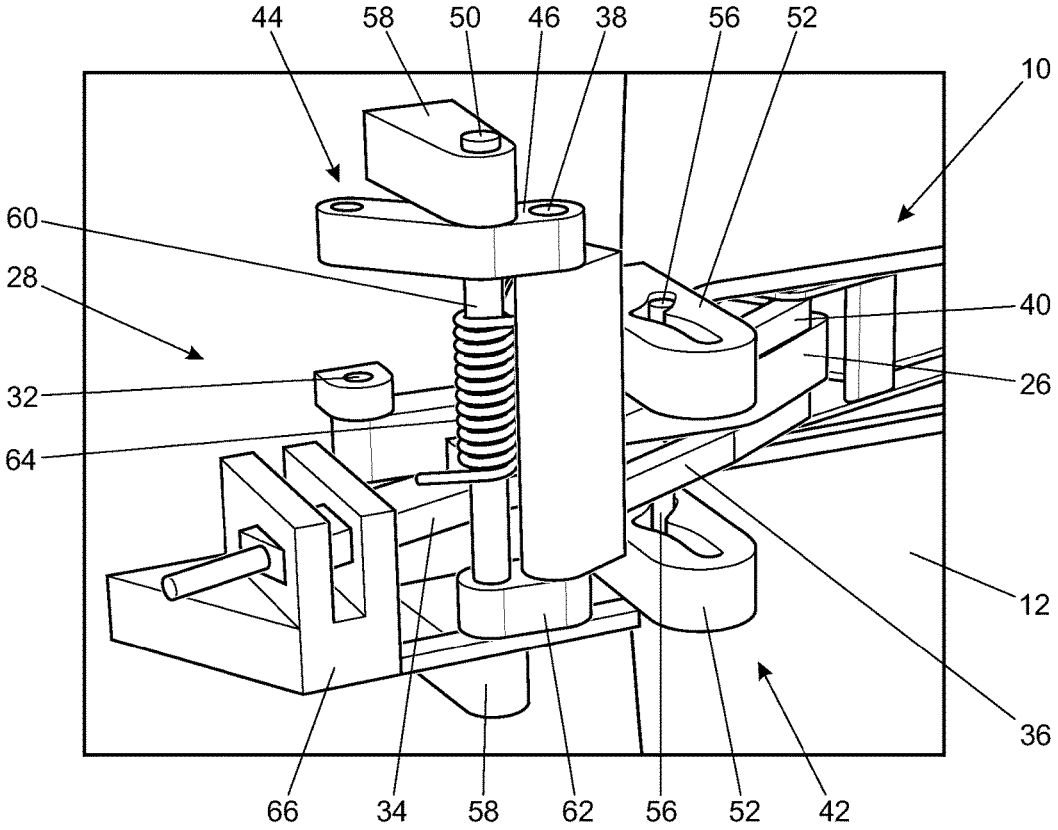

The door handle mechanism 28 of the invention is apparent in FIGS. 2(*a*) to 2(*c*) and FIGS. 3(*a*) to 3(*c*), which show the mechanism 28 respectively from above and from behind the door skin 12, in each of its three states. For ease of reference, the mechanism 28 is shown enlarged in FIGS. 4(*a*) and 4(*b*), in FIGS. 5(*a*) and 5(*b*) and in FIGS. 6(*a*) and 6(*b*), which in turn follow the mechanism 28 from the stowed state to the deployed state and then to the operative state.

The mechanism 28 has to meet various requirements in addition to manoeuvring the handle 10 into and out of the deployed state. It must fit into the slim space available between the window glass path and the door skin, whilst maintaining ergonomic size, shape and access in use, and without infringing regulations on exterior projections.

The mechanism 28 is attached to the door structure inside the door skin 12, beside one end of the slot 14. The various pivot axes of the mechanism 28 lie substantially parallel to each other. References to 'fixed' or 'floating' features such as pivot axes in the following description are with respect to the door structure to which the mechanism 28 is attached.

In overview, the mechanism comprises:

- a first link being a primary link 26 that is hinged at one end about a primary link pivot axis 32 and that terminates at the other end in an outer pivot axis 30 about which the primary link 26 is hinged to the handle 10;
- an actuator rod 34 acting on the primary link 26 that moves the primary link 26 to drive the handle 10 between the stowed and deployed states;
- a second link being a control arm 36 that is hinged at one end about a floating control arm pivot axis 38 and that terminates at the other end in an inner pivot axis 40 about which the control arm 36 is hinged to the handle 10, inboard of the outer pivot axis 30;
- a guide 42 that restrains floating movement of the control arm pivot axis 38 as the handle 10 moves between the stowed and deployed states, but then allows floating movement of the control arm pivot axis 38 as the handle 10 is moved between the deployed and operative states; and
- a crank 44 having swinging arms 46, 48 opposed about a fixed crank pivot axis 50, one arm 46 carrying a control arm pivot to define the floating control arm pivot axis 38 and an opposed arm 48 acting on the Bowden cable (not shown) to unlatch the door as the control arm pivot axis 38 moves in response to the handle 10 being pulled from the deployed state to the operative state.

The primary link 26 and the control arm 36 are connected to one end of the handle 10 at the outer and inner pivot axes 30, 40 respectively, thereby creating a compact four-bar linkage that carries the handle 10 with respect to the door structure. The inner pivot axis 40 is positioned slightly beyond the outer pivot axis 30 in the longitudinal direction of the handle 10, namely a direction transverse to the pivot axes of the mechanism 28, generally parallel to the door skin 12.

Comparison of FIGS. 2(*a*) to 2(*c*) shows that the relative positions of the inner and outer pivot axes 30, 40 are substantially the same in the stowed and deployed states, which determines the largely translational movement of the handle 10 between those two states. However, as a user pulls the handle 10 into the operative state, the handle 10 pivots with respect to the primary link 26 about the outer pivot axis 30. This moves the inner pivot axis 40 still further beyond the outer pivot axis 30 in the longitudinal direction of the handle 10—in effect, pulling the inner pivot axis 40, and with it the control arm 36, around the outer pivot axis 30 when the guide 42 allows the control arm pivot axis 38 to float.

During deployment travel of the handle 10, the guide 42 restricts the mechanism 28 to behave as a four-bar linkage with two stationary pivots 32, 38. By restraining movement of the control arm pivot axis 38, the guide 42 inhibits movement of the crank 44 so that the door cannot unlatch at this stage.

More specifically, the guide 42 is defined by a track, being a slot in a guide member 52. The slot has a first track portion 54*a* defining an arcuate path for a follower, being a pin 56 fixed to the control arm 36. The centre of curvature of that path defines a fixed position for the floating control arm pivot axis 38, hence locking the crank 44 while the pin 56 remains in the first track portion 54*a*. The respective ends of the first track portion 54*a* correspond to the stowed and deployed states of the handle 10.

At the end of the first track portion 54*a* that corresponds to the deployed state of the handle 10, the slot deviates sharply into a second track portion 54*b*. It is this second track portion 54*b* that allows the handle 10 to be pivoted from the deployed state into the operative state as a user pulls the deployed handle 10. During that movement, the pin 56 moves along the second track portion 54*b* until it reaches the end of the second track portion 54*b* when the handle 10 reaches its limit of pivoting travel in the operative state. In so doing, the floating control arm pivot axis 38 defined by the control arm pivot on one arm 46 of the crank 44 is pulled about the crank pivot axis 50. That movement causes the other arm 48 of the crank 44 to pull the Bowden cable to unlatch the door.

Having described broadly how the mechanism works, further details of the illustrated embodiment will now be described for completeness. Most of those details will be appreciated best in the enlarged perspective views of the mechanism in FIGS. 4(*b*), 5(*b*) and 6(*b*).

In the illustrated embodiment, the control arm 36 is a forked member comprising spaced elements in the form of two parallel prongs, each prong terminating in a respective pivot part with those pivot parts together defining the inner pivot axis 40. Similarly the guide member 52 comprises two pillars spaced from but aligned with each other, each pillar having a respective slot to define the track portions 54*a*, 54*b* cooperating with a pin 56 of a respective one of the prongs of the control arm 36.

A bridge comprising uprights 58 joined by a spindle 60 defines the crank pivot axis 50. The crank 44 is at one end of the spindle 60 and has an arm 46 pivotally supporting one side of the control arm 36. A secondary arm 62 disposed at the other end of the spindle 60 pivotally supports the other side of the control arm 36. Between them, the arm 46 of the crank 44 and the secondary arm 62 define the control arm pivot axis 38, that axis 38 thereby being able to float—when permitted by the guide 42—around the spindle 60 of the bridge that defines the crank pivot axis 50.

A coil spring 64 around the spindle 60 of the bridge biases the crank 44, the pivots defining the floating control arm pivot axis 38, and hence the control arm 36, to pull the handle 10 back to the deployed state from the operative state when the user releases it.

The actuator rod 34 is movable reciprocally along a channel extending through a fixed bearing member 66, in which the rod 34 is a sliding fit. A proximal end of the rod 34 is driven by suitable drive means such as a solenoid, which is well known and not shown. A distal end of the rod 34 has a serpentine slot defining a drive track to drive a follower, the follower being a primary link pin 68 projecting laterally from the primary link 26. The primary link pin 68 is located near the primary link pivot axis 32 to maximise movement of the primary link 26 in response to movement of the actuator rod 34.

The drive track of the actuator rod 34 has a ramped central cam portion 70*a* that transforms linear movement of the actuator rod 34 into pivotal movement of the primary link 26. This cam action drives movement of the primary link 26 and hence also of the handle 10 in both directions between the stowed and proximal states.

Detent positions are provided at each end of the central cam portion 70*a* of the drive track 68. One is a stowed lock detent 70*b* in which the primary link pin 68 lies when the actuator rod 34 is at the proximal end of its movement, to lock the primary link 26 and hence the handle 10 in the stowed state. The other is a deployed lock detent 70*c* in which the primary link pin 68 lies when the actuator rod 34 is at the distal end of its movement, to lock the primary link 26 and hence the handle 10 in the deployed state.

This facility to lock the primary link 26 in the stowed or deployed states ensures a clean disconnect between the two separate functions of the mechanism 28. Thus, when the pin 56 of the control arm 36 is in the second track portion 54*b* and the handle 10 is therefore free to move between the deployed and operative states, the primary link 26 is locked so that the outer pivot axis 30 about which the handle 10 pivots cannot move.

The primary link 26 is disposed compactly between the prongs of the control arm 36 and whilst functionally a U-link is actually shaped like a numeral '7'. The foot of the '7' is at the primary link pivot axis 32. The top arm of the '7' is nearly perpendicular to the door skin 12 in the stowed state and swings out with the handle 10 beyond the door skin 12 as the handle 10 moves into the deployed state. In so doing, the top arm of the '7' is accommodated within, and concealed by, the enlarged hollow end piece 22 of the handle 10 as mentioned already above.

Many variations are possible without departing from the inventive concept. For example, a cam of rotary, linear or helical configuration may replace the actuator rod 34. Also, it may be possible to release the latch using movement of the control arm directly, without recourse to a crank arrangement. A telescoping or otherwise extending control arm may be used for this purpose.

Thus, the invention provides a mechanism for a deploying door handle that separates the motions of deploying the handle and releasing the door. The handle starts from a position flush with the door skin and when deployed it reveals a strap-type configuration, which is used to release the door latch and to manipulate the door to an open position in the normal way of a strap-type handle. The motion of deployment cannot release the door from a latched state and is separate and independent from the motion of latch release.

The mechanism uses a four-bar linkage to move the handle from the stowed to the deployed states and back again, and locks the handle in either of those two static states after that transition. Once the handle is in the deployed state, the mechanism ceases to behave as a four-bar linkage when part of that linkage is released to allow the same mechanism to release the door latch.

The invention claimed is:

1. A handle arrangement for a vehicle door, the arrangement comprising a strap handle and a linkage mechanism arranged to couple the handle to the door for movement between a first position in which an outer surface of the handle lies substantially flush with and substantially continuous with an outer surface of the door surrounding the handle arrangement and a second position in which the handle protrudes from the outer surface of the door, wherein the strap handle comprises a hand grip that forms part of a loop, the hand grip being disposed between respective first and second ends of the handle, the outer surface of the handle defining a plane which lies substantially parallel to the plane of the outer surface of the door surrounding the handle when the handle is in the second position, and wherein the first end of the handle is spaced axially apart and separated from the second end of the handle along a longitudinal axis of the handle that extends along the length of the handle and is parallel to the plane of the outer surface of the door surrounding the handle when the handle is in the first position, wherein the linkage mechanism is arranged to permit the handle to linearly translate from the first position to the second position, and to permit the handle in the second position to rotate about a pivot point to a third position thereby to disengage a door latch or the like, wherein the linkage mechanism is coupled to only one of the first and second ends of the handle and movement of the linkage mechanism on rotation of the handle to the third position causes disengagement of the door latch or the like, and wherein the handle arrangement further comprises an actuator to drive movement of the linkage mechanism to move the handle at least from the first position to the second position.

2. A handle arrangement as claimed in claim 1, wherein the handle is movable between stowed, deployed and operative states, that movement being controlled by the linkage mechanism, the linkage mechanism having first and second links each connected to a supporting structure and to the handle; wherein the second link is connected to the supporting structure by a joint defining a pivot axis that is movable is response to movement of the handle between the deployed state and the operative state, that movement of the pivot axis being used to unlatch a door or other closure associated with the handle.

3. A handle arrangement as claimed in claim 2, wherein movement of the pivot axis is restrained as the handle moves between the stowed and deployed states.

4. A handle arrangement as claimed in claim 2, wherein movement of the pivot axis is controlled by a guide defining a guide path, the second link having a follower that follows the guide path as the handle moves.

5. A handle arrangement as claimed in claim 4, wherein the guide path comprises a first portion that restrains movement of the pivot axis as the handle moves between the stowed and deployed states, and a second portion adjoining and communicating with the first portion that enables movement of the pivot axis as the handle moves between the deployed and operative states.

6. A handle arrangement as claimed in claim 2, wherein the movable pivot axis is movable around a further pivot axis.

7. A handle arrangement as claimed in claim 6, wherein the movable pivot axis is defined by a pivot on a crank arm that is pivotable about the further pivot axis.

8. A handle arrangement as claimed in claim 2, wherein the handle is pivotally attached to the first link and pivots about that link when moving from the deployed state to the operative state.

9. A handle arrangement as claimed in claim 2, wherein the first link moves within a hollow part of the handle as the handle moves between the stowed and deployed states.

10. A handle arrangement as claimed in claim 2, wherein the actuator acts on at least one of the links to drive movement of the link between the stowed and deployed states.

11. A handle arrangement as claimed in claim 10, wherein the actuator and the link are cooperable to lock the link in at least one of the stowed and deployed states.

12. A handle arrangement as claimed in claim 2, wherein the second link comprises spaced elements and the first link is disposed between those elements.

13. A handle arrangement as claimed in claim 1, wherein the links define a four-bar linkage as the handle moves between the stowed and deployed states.

14. A handle arrangement as claimed in claim 13, wherein one of the links is decoupled from the four-bar linkage when the handle moves between the deployed and operative states.

15. A handle arrangement as claimed in claim 2, wherein substantially all of the mechanism, other than the parts of the links connecting to the handle, is disposed to an end or side of the handle.

16. A vehicle, a door or other closure, or a structure adapted to receive a door or other closure, fitted with a handle arrangement as defined in claim 1.

17. A handle arrangement as claimed in claim 1, wherein:

when in the first position, the handle is disposed within a slot in the vehicle door and lies substantially flush with an outer surface of the door such that the loop of the handle is concealed; and when in the second position, the handle protrudes from the outer surface of the door such that the loop of the handle is revealed.

18. A handle arrangement for a vehicle door, the arrangement comprising a strap handle and a linkage mechanism arranged to couple the handle to the door for movement between a first position in which an outer surface of the handle lies substantially flush with and substantially continuous with an outer surface of the door surrounding the handle arrangement and a second position in which the handle protrudes from the outer surface of the door, wherein the strap handle comprises a hand grip, the hand grip being disposed between respective first and second ends of the handle, the outer surface of the handle defining a plane which lies substantially parallel to the plane of the outer surface of the door surrounding the handle when the handle is in the second position, and wherein the first end of the handle is spaced axially apart and separated from the second end of the handle along a longitudinal axis of the handle that extends along the length of the handle and is parallel to the plane of the outer surface of the door surrounding the handle when the handle is in the first position, wherein the linkage mechanism comprises:

a first link being a primary link that is hinged at one end about a primary link pivot axis and that terminates at the other end in an outer pivot axis about which the primary link is hinged to the strap handle;

an actuator rod acting on the primary link that moves the primary link to drive the strap handle between the first and second positions; and a second link being a control arm that is hinged at one end about a floating control arm pivot axis and that terminates at the other end in an inner pivot axis about which the control arm is hinged to the handle, inboard of the outer pivot axis;

wherein the linkage mechanism is arranged to permit the handle to linearly translate from the first position to the second position, and to permit the handle in the second position to rotate about the outer pivot axis to a third position thereby to disengage a door latch or the like, and wherein the linkage mechanism comprises a slotted guide that restrains floating movement of the control arm pivot axis as the strap handle moves between the first and second positions, such that the door latch or the like does not disengage during linear translation from the first to the second position, but then allows floating movement of the control arm pivot axis as the strap handle is moved between the second and third positions.

19. A handle arrangement as claimed in claim 18, wherein the guide path comprises a first portion that restrains movement of the pivot axis as the handle moves between the first and second positions, and a second portion adjoining and communicating with the first portion that enables movement of the pivot axis as the handle moves between the second and first positions.

20. A handle arrangement as claimed in claim 18, wherein the first link moves within a hollow part of the handle as the handle moves between the first and second positions.

* * * * *